US009987183B2

(12) United States Patent
Yoon

(10) Patent No.: US 9,987,183 B2
(45) Date of Patent: Jun. 5, 2018

(54) OVERLAY PORTABLE HYPERBARIC OXYGEN CHAMBER

(71) Applicant: IBEX MEDICAL SYSTEMS Co., Ltd., Wonju-si, Gangwon-do (KR)

(72) Inventor: Suc Ho Yoon, Seoul (KR)

(73) Assignee: IBEX MEDICAL SYSTEMS Co., Ltd., Wonju-si (KR)

( * ) Notice: Subject to any disclaimer, the term of this patent is extended or adjusted under 35 U.S.C. 154(b) by 492 days.

(21) Appl. No.: 14/645,813

(22) Filed: Mar. 12, 2015

(65) Prior Publication Data

US 2016/0120724 A1 May 5, 2016

(30) Foreign Application Priority Data

Oct. 29, 2014 (KR) ..... 10-2014-0148432

(51) Int. Cl.
*A61G 10/02* (2006.01)
*A62B 31/00* (2006.01)

(52) U.S. Cl.
CPC ..... *A61G 10/026* (2013.01); *A62B 31/00* (2013.01)

(58) Field of Classification Search
CPC ..... A61G 10/026; A62B 31/00; B63C 11/32; B63C 11/324; B63C 11/325; B63C 11/34; A61M 16/00; A61M 35/00
USPC ..... 128/200.24, 202, 12, 205.26; 24/382, 24/384
See application file for complete search history.

(56) References Cited

U.S. PATENT DOCUMENTS 2,347,583 A * 4/1944 Vartabedian ..... B63C 9/1055 2/96
2,615,224 A * 10/1952 Shur ..... A44B 19/32 24/384
3,877,427 A * 4/1975 Alexeev ..... A61G 10/026 128/202.13
4,485,806 A * 12/1984 Akers ..... A61G 10/005 128/873
4,974,829 A * 12/1990 Gamow ..... A61G 10/026 128/200.12
5,109,837 A * 5/1992 Gamow ..... A61G 10/026 128/200.24
5,467,764 A * 11/1995 Gamow ..... A61G 10/026 128/200.24

(Continued)

FOREIGN PATENT DOCUMENTS

CN 2628026 Y * 7/2004
DE 847474 C * 8/1952 ..... B63C 11/325

(Continued)

OTHER PUBLICATIONS

Machine translation of CN 2628026 Y.*

*Primary Examiner* — (Jackie) Tan-Uyen T Ho
*Assistant Examiner* — Joseph D Boecker
(74) *Attorney, Agent, or Firm* — Novick, Kim & Lee, PLLC; Jae Youn Kim

(57) ABSTRACT

The present invention relates to a portable and foldable oxygen chamber, and more particularly, relates to a portable and foldable hyperbaric oxygen chamber that may be reduced in volume and conveniently carried and kept by including a tube capable of accommodating a patient and a body part which protects the tube and is divided into multiple cylindrical bodies formed in a longitudinal direction and inserted into and overlapped with one another.

7 Claims, 9 Drawing Sheets

(56) References Cited

U.S. PATENT DOCUMENTS

| | | | | | |
|---|---|---|---|---|---|
| 5,678,543 | A * | 10/1997 | Bower | A61G 10/026 | 128/202.12 |
| 2005/0109381 | A1* | 5/2005 | Mosteller | A61G 10/026 | 135/97 |
| 2008/0006272 | A1* | 1/2008 | Lewis | A61G 10/026 | 128/205.26 |
| 2008/0210239 | A1* | 9/2008 | Lewis | A62B 31/00 | 128/205.26 |
| 2010/0269311 | A1* | 10/2010 | Jacobsen | A44B 19/32 | 24/382 |
| 2011/0226252 | A1* | 9/2011 | Milne | A61G 10/023 | 128/205.26 |
| 2013/0343875 | A1* | 12/2013 | McKeeman | F04D 29/58 | 415/116 |
| 2014/0366881 | A1* | 12/2014 | McKeeman | A61M 16/20 | 128/205.24 |

FOREIGN PATENT DOCUMENTS

| | | | | |
|---|---|---|---|---|
| JP | 2015139523 | A * | 8/2015 | A61G 10/023 |
| KR | 10-0777358 | B1 | 11/2007 | |
| KR | 10-0822876 | B1 | 4/2008 | |
| KR | 20-0461141 | Y1 | 6/2012 | |
| KR | 20140087490 | A * | 7/2014 | |

* cited by examiner

OVERLAY PORTABLE HYPERBARIC OXYGEN CHAMBER

TECHNICAL FIELD

The present invention relates to a portable and foldable oxygen chamber, and more particularly, relates to a portable and foldable hyperbaric oxygen chamber that may be reduced in volume and conveniently carried and kept by including a tube capable of accommodating a patient and a body part which protects the tube and is divided into multiple cylindrical bodies formed in a longitudinal direction and inserted into and overlapped with one another.

BACKGROUND ART

A hyperbaric oxygen chamber is major equipment used for hyperbaric oxygen therapy in which a patient breathes 100% pure oxygen for one to two hours in a state where an atmospheric pressure is higher than general breathing environment, and is used to enhance therapy effect and quality by effectively providing oxygen to tissue cells damaged by an external injury, an infection, edema, or the like.

A hard chamber has been used for hyperbaric oxygen therapy described above, which is designed to withstand pressures of 2 to 10 pounds per square inch (psi) by using aluminum alloy. However, a hard chamber presents a problem of confined usage places such as a hospital, a military camp, and the like due to a significantly large volume. In other words, even though various therapy methods using the hyperbaric oxygen chamber have been disclosed, there has been a problem in that the hyperbaric oxygen chamber cannot be utilized for personal uses at home since the hyperbaric oxygen chamber is too heavy and large for domestic use.

A hyperbaric oxygen soft chamber has been developed to solve the above-mentioned problem, which is designed to withstand pressures of 2 to 4 psi using a soft polyurethane material which is easily carried and kept. However, while the soft chamber has advantages in that it is made of the soft material and easily carried, it also has several disadvantages in that it may not withstand high pressures compared to the hard chamber and thus make therapy ineffective and is vulnerable to damage resulting from impact due to characteristics of the soft chamber utilized for personal and domestic uses and thus is exposed to danger of a hyperbaric oxygen explosion or the like.

Patent Literature 1 relates to a high pressure oxygen tube, and more particularly, relates to a high pressure oxygen tube which includes a lower part supporting tube and a chamber having a space capable of accommodating a patient. This high pressure oxygen tube is distinguished by the expansion of the lower part supporting tube and the chamber with the hyperbaric oxygen injection. The high pressure oxygen tube is provided with entrance and exit means on the outside, making it convenient for the patient to enter and exit. However, the entrance and exit means is provided as a zipper and hyperbaric oxygen in the chamber may leak, which makes the tube vulnerable to the danger of the explosion or the like.

Patent Literature 2 relates to an oxygen capsule for dormancy which is characterized in that an airtight capsule is provided to prevent contact with outside air, a required amount of oxygen is supplied to the inside of the capsule from an oxygen generator, using an oxygen concentration controller in the capsule while carbon dioxide, dust, a smell, and the like generated from a user are removed through a high efficiency particulate air (HEPA) filter and a carbon filter, and a tuning cooler is provided to control temperature and humidity in the capsule increased due to carbon dioxide.

However, similarly to Patent Literature 1, Patent Literature 2 has had a problem of leakage of oxygen through an entrance since a capsule door corresponding to entrance and exit means is provided to simply function only as the entrance.

Patent Literature 3 relates to a ball-type high concentration oxygen capsule, and more particularly, relates to a ball-type high concentration oxygen capsule, which is a ball-type high concentration oxygen capsule having a shape of a tire tube and supplied with high concentration oxygen provided from an oxygen supply device such as an oxygen generator or a compressor, capable of treating a skin condition and healing a wound on a skin of a patient at an early stage through hyperbaric oxygen therapy in which the patient is seated inside the oxygen capsule and continuously breathes high concentration oxygen for a certain period of time, assisting in recovery from fatigue and promotion of health in a hospital, a sauna, a jimjilbang, a rest area, a beauty shop, or a barber shop, and increasing a concentration of oxygen inhaled in the capsule from 27 to 30% to almost 100% not only when an inhaler is not worn, but also when the inhaler is worn by including the inhaler in a main body of a cover. Patent Literature 3 has problems because the oxygen capsule uses only a capsule configured as a tube and thus is exposed to danger of a hyperbaric oxygen explosion when the tube is damaged by the external impact or the like, and uses an external zipper and an internal zipper as entrance and exit means of the tube and thus may not prevent hyperbaric oxygen from leaking through the zippers.

CITATION LIST

Patent Literature

[Patent Literature 1]
Korean registered patent No. 10-0777358
[Patent Literature 2]
Korean registered utility model No. 20-0461141
[Patent Literature 3]
Korean registered patent No. 10-0822876

SUMMARY OF INVENTION

Technical Problem

An objection of the present invention is to provide an oxygen chamber configured to be foldable so as to be easily used at home, and another object of the present invention is to provide a portable and foldable hyperbaric oxygen chamber designed to be easily carried and kept by including a foldable body part and to withstand hyperbaric oxygen.

Solution to Problem

To achieve the above-mentioned goals, the present invention provides a portable and foldable hyperbaric oxygen chamber including a tube, a body part, an oxygen controller, an oxygen injection pipe, and an oxygen inlet. More particularly, the portable and foldable hyperbaric oxygen chamber includes a tube securing a space capable of accommodating a user and a body part protecting the tube. The body part is divided into multiple cylindrical bodies formed along a longitudinal direction and inserted into and overlapped with one another, and includes a body entrance and the oxygen controller on one lateral face. The tube includes the oxygen inlet connected to the oxygen injection pipe entering from an outside on one lateral face.

Advantageous Effects of Invention

According to the present invention, a portable and foldable hyperbaric oxygen chamber is a chamber including a tube and a body part, and effective in more safely performing hyperbaric oxygen therapy by being configured in a double chamber structure that covers and protects the chamber with the body part from hyperbaric oxygen and the impact on the tube which are not bearable for the tube alone.

In addition, the body part includes multiple cylindrical bodies formed along a longitudinal direction, and multiple cylindrical bodies are inserted into and overlapped with one another such that the chamber may be easily carried and kept when the chamber is not used.

Moreover, a tube entrance provided on one lateral face of the tube includes external and internal zippers and thus is effective in preventing the easy leakage of hyperbaric oxygen in the tube.

DESCRIPTION OF EMBODIMENTS

Figure 1:
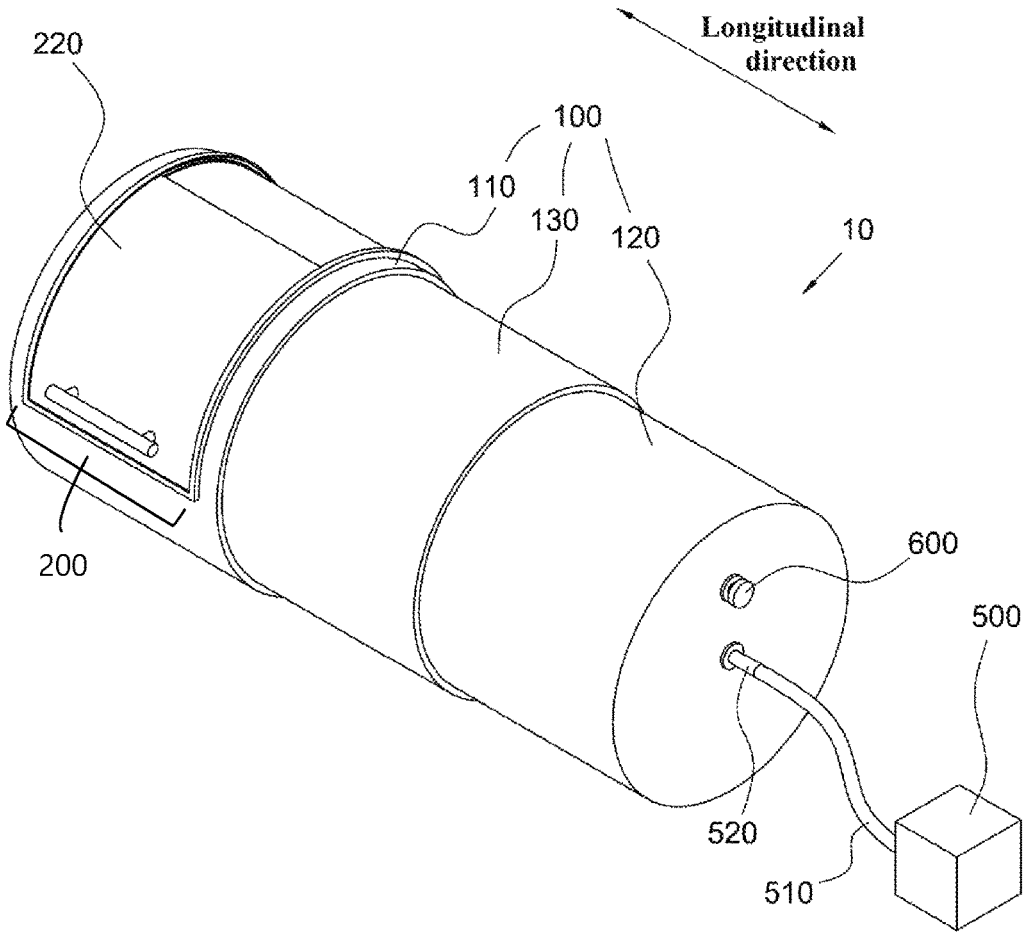
FIG. 1 is a perspective view illustrating a portable and foldable hyperbaric oxygen chamber according to an embodiment of the present invention.

Hereinafter, an embodiment of the present invention will be described in detail with reference to the attached drawings. In this instance, a size or a shape of a component may be exaggeratedly illustrated in the drawings for clarity and the convenience of the description. In addition, a term particularly defined based on a configuration and the effect of the present invention may vary in accordance with intention or convention of a user or an operator. The term should be defined based on description across the entire specification. Further, the spirit of the present invention is not limited to the proposed embodiment, and those skilled in the art and those who understand the spirit of the invention may easily implement another embodiment within the scope of the same spirit. This is also included in the scope of the present invention.

FIG. 1 is a perspective view illustrating a portable and foldable hyperbaric oxygen chamber 10 according to an embodiment of the present invention. Hereinafter, description will be made based on FIG. 1, and a reference drawing is separately mentioned for a configuration not illustrated in FIG. 1.

The portable and foldable hyperbaric oxygen chamber according to the present embodiment may include a body part 100, a body entrance 200, a tube 300, a body entrance 400, an oxygen generator 500, an oxygen injection pipe 510, an oxygen inlet 530, and an oxygen controller 600.

According to the present embodiment, the body part 100 may be provided as a cylindrical body part made of an aluminum alloy material, and the tube 300 may be provided as a cylindrical tube made of a polyurethane material. However, the present invention is not limited thereto.

Referring to FIG. 1, the body part 100 is provided as a cylindrical body part, and used by being laid in a longitudinal direction on a ground. In addition, the body part 100 secures a space therein for the tube 300, and the tube 300 includes a space to accommodate a patient and is provided on the inside of the body part 100 in a longitudinal direction similarly to the body part 100. To be specific, the body part 100 has an internal surface formed in a shape similar to that of an external surface of the tube 300 and thus is effective in preventing the tube 300 from being damaged due to hyperbaric oxygen by dispersing and absorbing pressure of the tube 300 even when the tube 300 expands by hyperbaric oxygen, and preventing the tube 300 from being damaged by an external impact.

Figure 3:
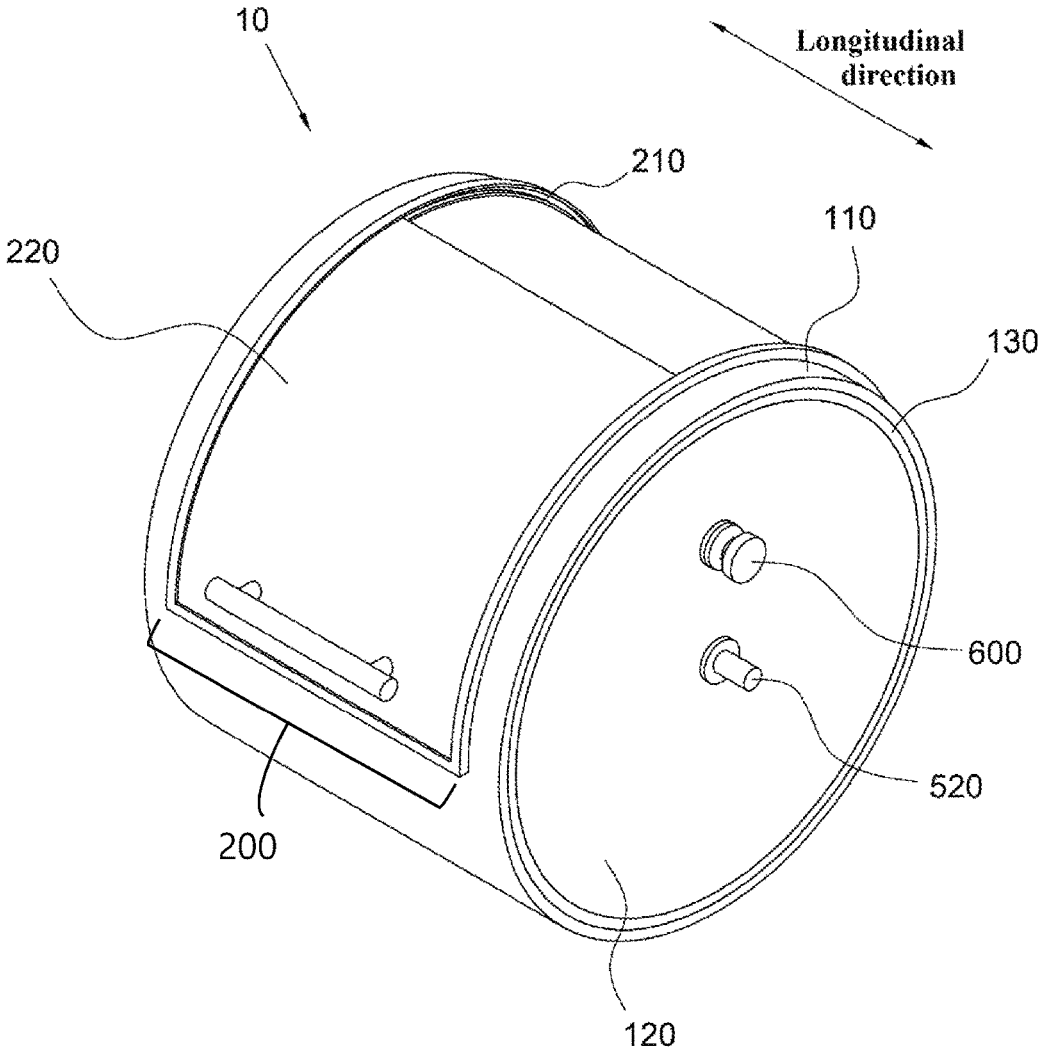
FIG. 3 is a perspective view illustrating that the portable and foldable hyperbaric oxygen chamber is folded by inserting the bodies of the body part into one another according to the present embodiment.

Referring to FIG. 3, the body part 100 includes the body entrance 200 provided on a lateral face thereof, and the tube 300 includes the tube entrance 400 provided on a lateral face thereof. To be specific, the body entrance 200 and the tube entrance 400 are provided at positions corresponding to each other. The phrase "corresponding to each other" indicates that the body entrance 200 and the tube entrance 400 are provided at the same position, and the positions thereof are in the same direction. In other words, when the body entrance 200 is opened, the tube entrance 400 is provided in an open part of the body entrance 200 and thus a user may easily operate the tube entrance 400 in the open part. Therefore, the user may conveniently enter the chamber 10.

Figure 7:
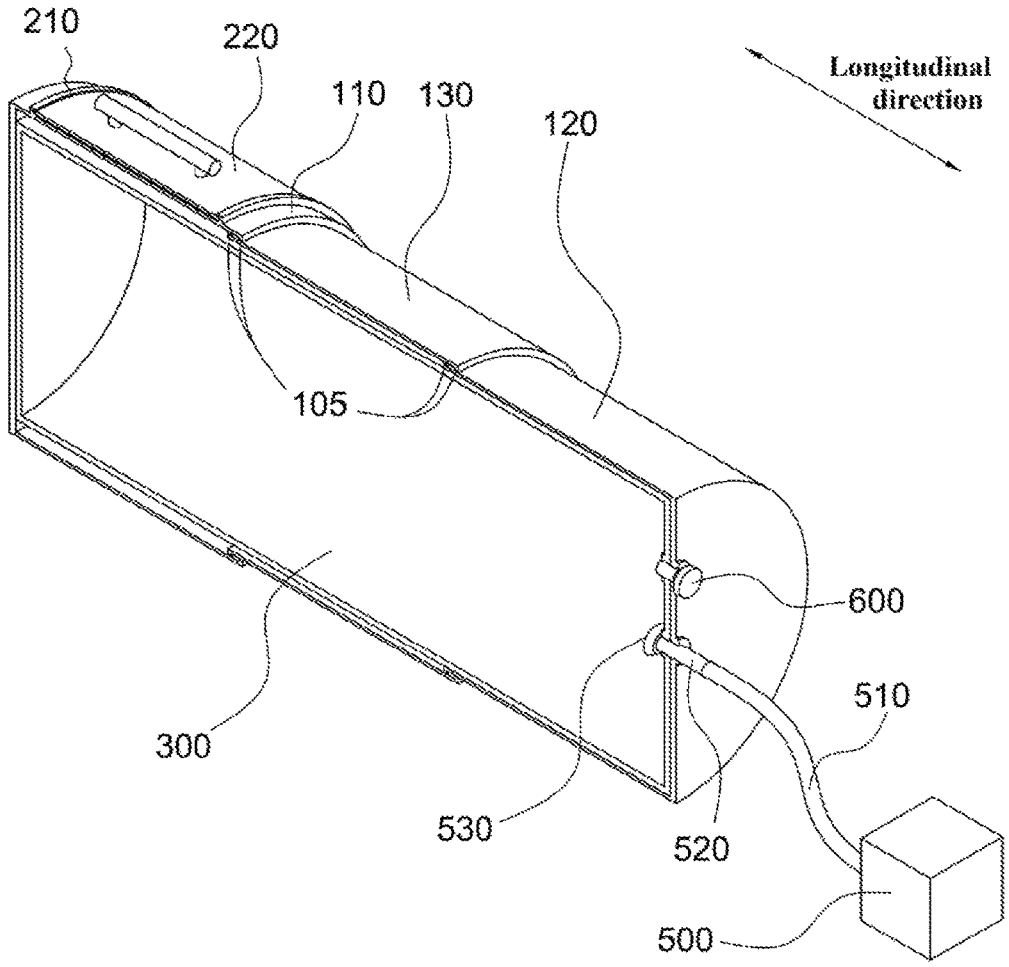
FIG. 7 is a cross-sectional view illustrating the portable and foldable hyperbaric oxygen chamber according to the present embodiment.

Referring to FIG. 7, the oxygen inlet 530 is provided on one end face of the tube 300, and an oxygen passage entrance 520 is provided on one end face of the body part 100. The oxygen inlet 530 and the oxygen passage entrance 520 are provided at the same position, and the oxygen injection pipe 510 is connected to the oxygen inlet 530 and to the oxygen generator 500 by exiting the oxygen passage entrance 520. To be specific, the oxygen generator 500 is connected to the oxygen injection pipe 510, and the oxygen injection pipe 510 is connected to the oxygen inlet 530 provided on the one end face of the tube 300 by passing through the oxygen passage entrance 520 provided on the one end face of the body part 100. To be more specific, the oxygen inlet 530 and the oxygen passage entrance 520 are provided in the same direction, and inner peripheral surfaces of the oxygen inlet 530 and the oxygen passage entrance 520 correspond to an outer peripheral surface of the oxygen injection pipe 510.

In other words, oxygen generated from the oxygen generator 500 is injected into the tube 300 through the oxygen injection pipe 510 and the oxygen passage entrance 520, and hyperbaric oxygen in the tube 300 is prevented from leakage since the inner peripheral surfaces of the oxygen inlet 530 and the oxygen passage entrance 520 correspond to the outer peripheral surface of the oxygen injection pipe 510.

Referring to FIG. 7, the oxygen controller 600 is provided on the one end face of the body part 100 and connected to the one end face of the tube 300 such that the user may adjust the amount of gas from the inside or the outside of the chamber 10. To be specific, the oxygen controller 600 may include a valve to adjust oxygen emissions and a filter to adjust the amount of gas other than oxygen. To be more specific, the oxygen controller 600 protrudes outward from the one end face of the body part 100, and is connected to the one end face of the tube 300 by passing inward through the body part 100. In addition, the oxygen controller 600 includes valves provided on the inside of the tube 300 and the outside of the body part 100 and thus the user may adjust the amount of oxygen and gas from the inside of the tube 300 and the outside of the body part 100.

Figure 2:
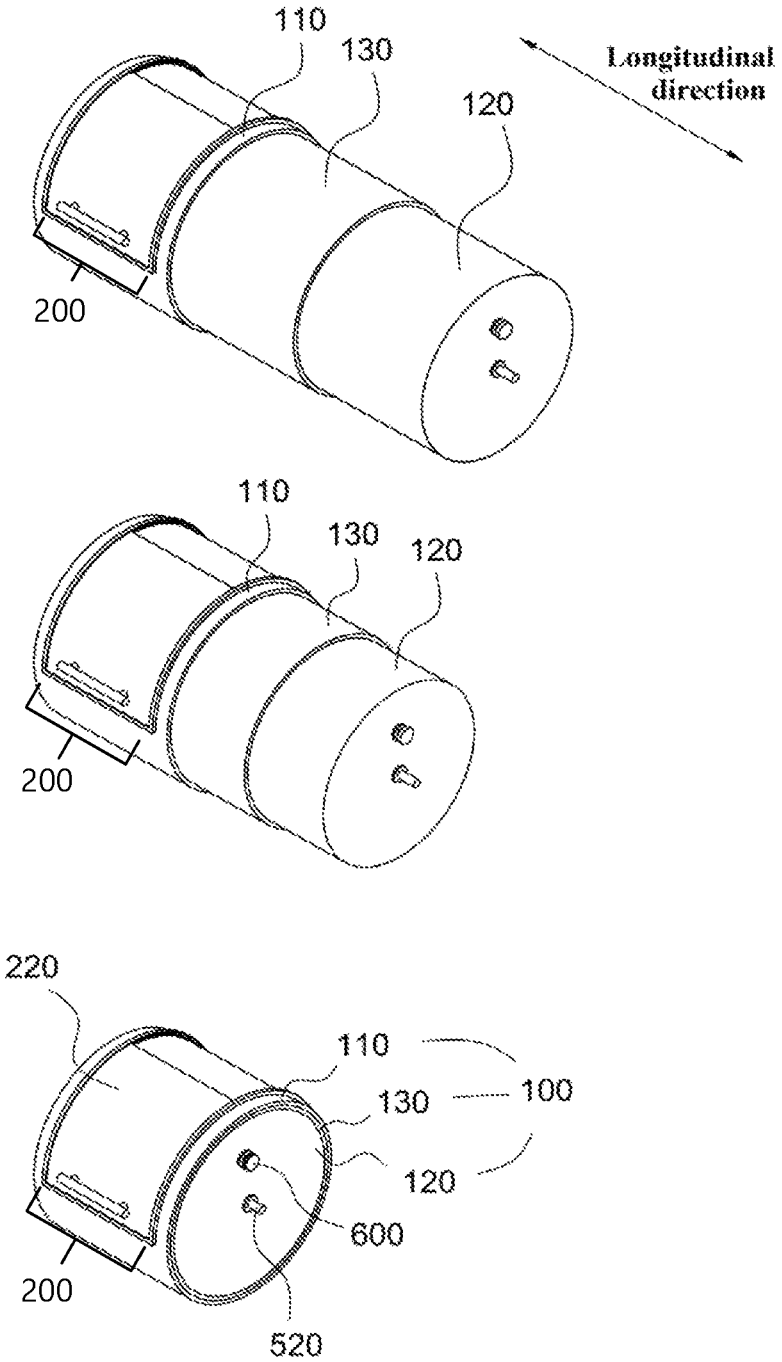
FIG. 2 is a perspective view illustrating that bodies of a body part of the portable and foldable hyperbaric oxygen chamber are inserted into and overlapped with one another according to the present embodiment.

In the present embodiment, referring to FIGS. 2 and 7, the body part 100 is divided into multiple cylindrical bodies formed in the longitudinal direction such that the bodies are inserted into and overlapped with one another. To be specific, the body part 100 includes cylindrical bodies A 110 and B 120, each of which has an one open end, provided at both ends of the body part 100 such that open parts thereof face each other, and at least one cylindrical body C 130 both having open ends provided between the cylindrical body A 110 and the cylindrical body B 120. To be more specific, an inner peripheral surface of the body A 110 corresponds to an outer peripheral surface of the body C 130, and an inner peripheral surface of the body C 130 corresponds to an outer peripheral surface of the body B 120 such that the body A 110, the body B 120, and the body C 130 are overlapped with one another.

In other words, the body part 100 includes the body A 110, the body C 130, and the body B 120 arranged in order. Thus, when the body part 100 is folded, the body C 130 is included in and overlapped with the body A 110, and the body B 120 is included in and overlapped with the body C 130. When the body part 100 is completely folded, a volume of the body part 100 decreases, which allows the user to easily carry and keep the chamber 10.

Figure 8:
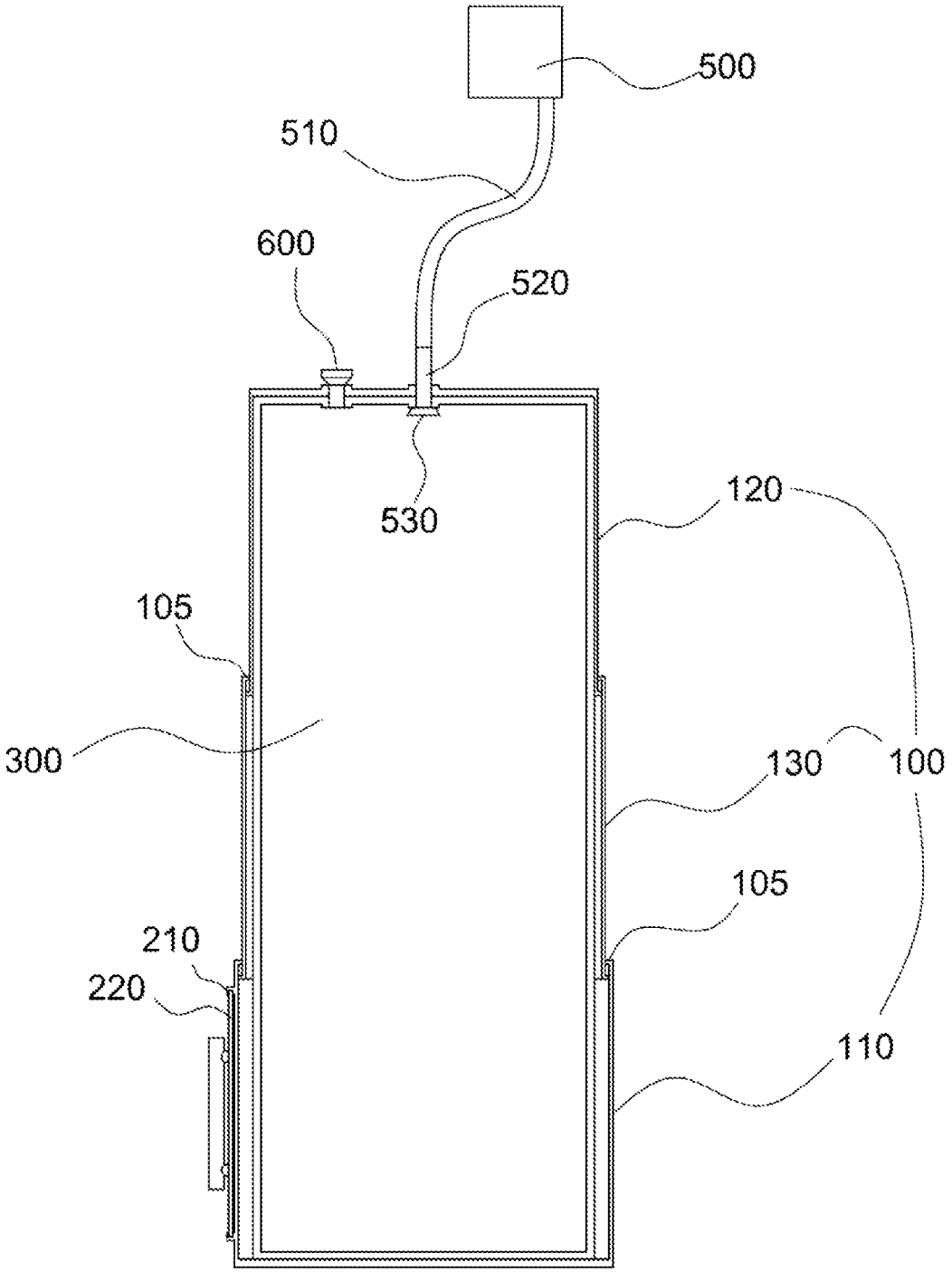
FIG. 8 is a cross-sectional view illustrating the portable and foldable hyperbaric oxygen chamber according to the present embodiment.

Referring to FIGS. 7 and 8, the body A 110 includes a separation preventing projection 105 protruding from the inner peripheral surface at the one open part, and the body C 130 includes a separation preventing projection 105 protruding from the outer peripheral surface at one end. To be specific, the separation preventing projection 105 is provided to prevent the body C 130 inserted into the body A 110 from being separated, which is protruding in a direction where the body A 110 and the body C 130 which face each other.

In addition, the body B 120 includes a separation preventing projection 105 protruding from the outer peripheral surface at the one open part, and the body C 130 includes a separation preventing projection 105 protruding from the inner peripheral surface at the other one end. To be specific, the separation preventing projections 105 is provided to prevent the body B 120 inserted into the body C 130 from being separated, which is protruding in a direction where the body B 120 and the body C 130 face each other.

In other words, even when the body parts 100 of the body A 110, the body C 130, and the body B 120 expand by being injected with hyperbaric oxygen and repel one another, they are not separated from one other since the separation preventing projection 105 is provided.

Referring to FIG. 3, the body entrance 200 includes a cover 220 and guide rails 210, and is provided on a lateral face of the body A 110. To be specific, the body A 110 includes a pair of guide rails 210 formed along an outer peripheral surface, an opening is formed between the guide rails 210, and the cover 220 having the same size as that of the opening, is inserted into the guide rails 210. In this way, the body entrance 200 is provided as a sliding body entrance. To be more specific, the pair of guide rails 210 formed along the outer peripheral surface of the body A 110 include a groove formed along a longitudinal direction in an inner part where the guide rails 210 face each other such that the cover 220 is inserted into the groove, and one ends and the other ends of the pair of guide rails 210 are connected to each other so that the body part 100 is airtight when the cover 220 is closed. To be more specific, the guide rails 210 protruding from an external surface is provided at a rim of the open part of the body entrance 200 provided in the body A 110, the groove is provided along internal surfaces of the guide rails 210, and the cover 220 is inserted into the groove. In other words, the body entrance 220 is a sliding body entrance and is effective in preventing hyperbaric oxygen leakage since the body part 100 is airtight when the cover 220 is closed.

Figure 4:
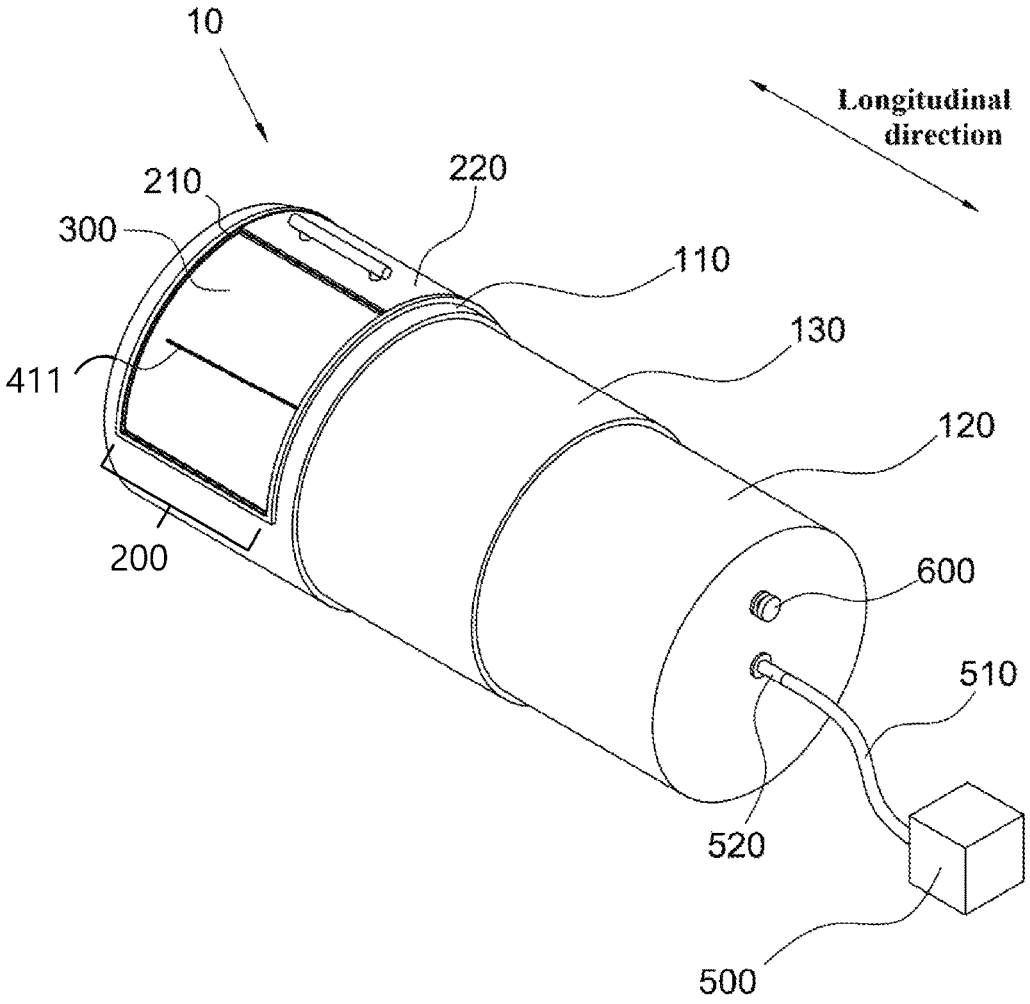
FIG. 4 is a perspective view illustrating the portable and foldable hyperbaric oxygen chamber according to the present embodiment.
Figure 5:
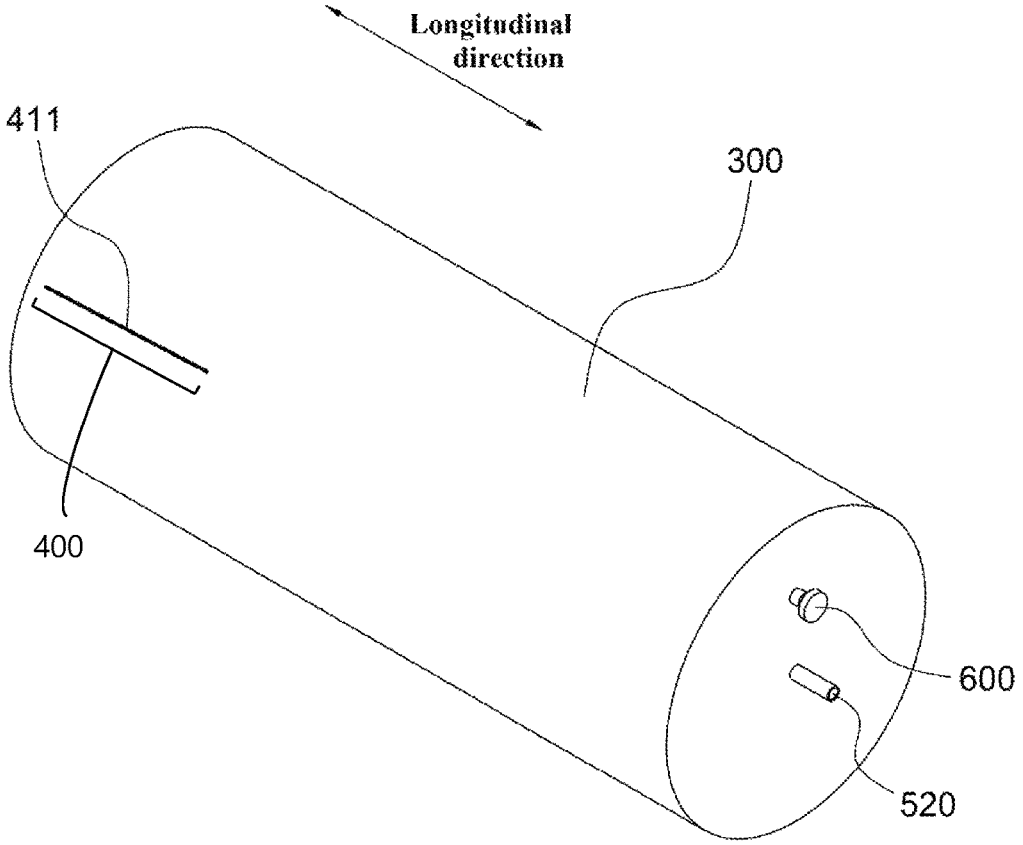
FIG. 5 is a perspective view illustrating a tube of the portable and foldable hyperbaric oxygen chamber according to the present embodiment.
Figure 6A:
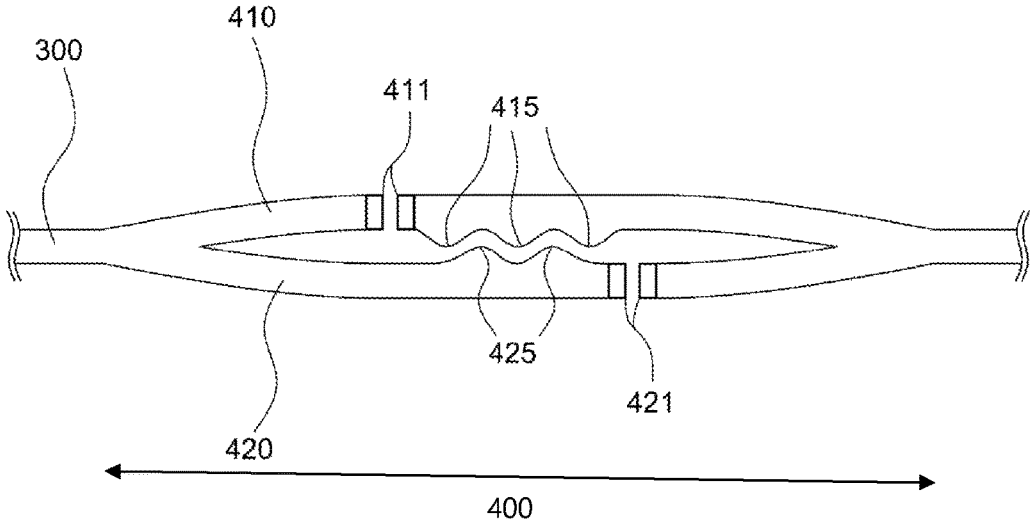
FIG. 6A is a cross-sectional view illustrating a tube of the portable and foldable hyperbaric oxygen chamber according to one embodiment of the present embodiment.

Referring to FIGS. 4 and 6A, the tube entrance 400 is provided at the same position as that of the body entrance 200. In addition, the tube entrance 400 includes an external zipper 411 and an internal zipper 421 provided side by side, the external zipper 411 and the internal zipper 421 are provided separately from each other with a certain space to make the zippers do not overlap each other, and one or more protrusions 415 and 425 are formed between the external zipper 411 and the internal zipper 421. To be specific, the tube entrance 400 includes an open part divided into an outer skin 410 and an inner skin 420 such that cross sections thereof form the external zipper 411 and the internal zipper 421, and the one or more protrusions 415 and 425 formed along longitudinal directions of the zippers between the outer skin 410 and the inner skin 420. To be more specific, referring to FIG. 6A, the tube entrance 400 includes the first protrusion 415 provided on the outer skin 410 and the second protrusion 425 provided on the inner skin 420. In this instance, the first protrusion 415 and the second protrusion 425 are positioned between the external zipper 411 and the internal zipper 421 and separated from each other by a size of a protrusion such that the protrusions are connected with each other when the outer skin 410 and the inner skin 420 are close to each other.

In other words, when hyperbaric oxygen is inserted into the tube 300, oxygen leakage is prevented twice by the external zipper 411 and the internal zipper 421. When the tube 300 expands, the inner skin 420 pushes the outer skin 410 outward due to hyperbaric oxygen. Then, the first protrusion 415 is connected with the second protrusion 425 to prevent hyperbaric oxygen leakage from the tube 300 and protect the external zipper 411 and the internal zipper 421.

Figure 6B:
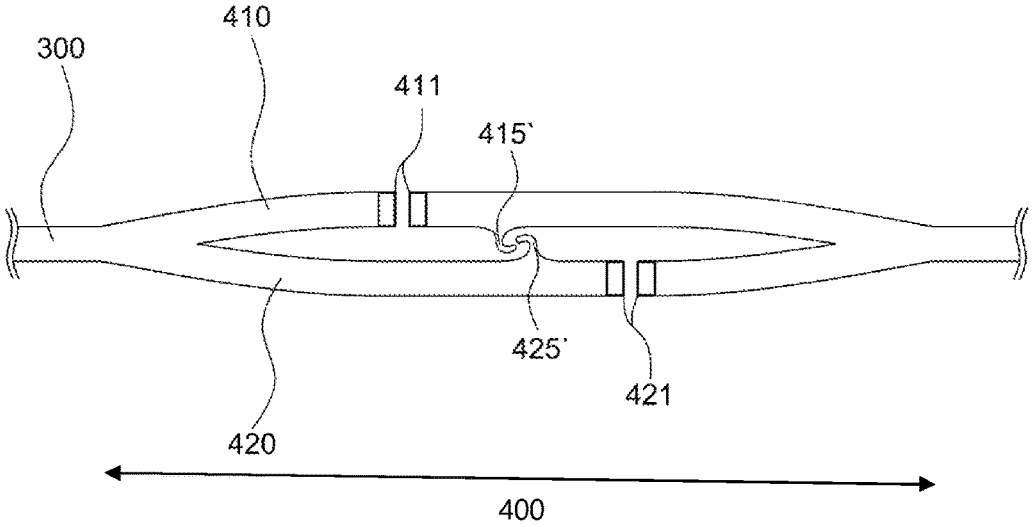
FIG. 6*b* is a cross-sectional view illustrating a tube of the portable and foldable hyperbaric oxygen chamber according to another embodiment of the present embodiment.

Referring to FIG. 6B, the first protrusion 415 and the second protrusion 425 may be provided as hooks 415' and 425' so that hyperbaric oxygen leakage is more effectively prevented. To be specific, each of the hooks 415' and 425' is a hook having a shape of a symbol "?", and formed along the longitudinal directions of the zippers between the outer skin 410 and the inner skin 420. To be more specific, the hooks 415' and 425', each of which has the shape of the symbol "?", need to be provided in opposite directions such that the hooks are connected with each other. To be specific, the first protrusion 415 includes a first hook 415' having a shape of a symbol "¿", and the second protrusion 425 includes a second hook 425' having the shape of the symbol "?".

In other words, when the tube expands by being injected with hyperbaric oxygen, the external zipper 411 and the internal zipper 421 prevent oxygen leakage twice. Moreover, when the tube expands, the connection between the first hook 415' and the second hook 425' becomes stronger as tension generated due to the expansion of the tube increases. This is effective in preventing hyperbaric oxygen leakage from the tube 300, and protecting the external zipper 411 and the internal zipper 421.

Figure 9:
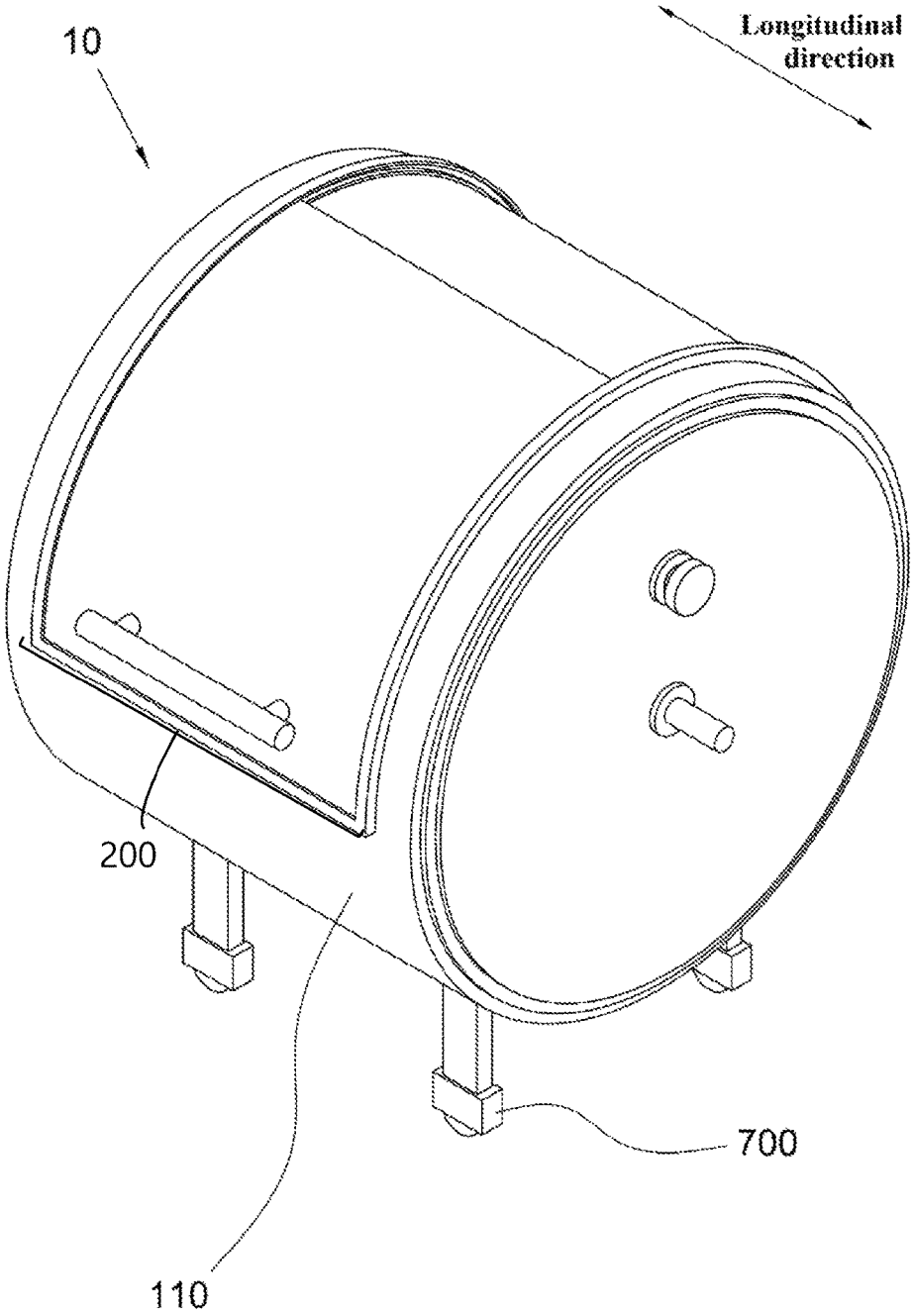
FIG. 9 is a perspective view illustrating a caster connected with a body A of the portable and foldable hyperbaric oxygen chamber according to the present embodiment.

Referring to FIG. 9, the body part 100 includes attachable and detachable means of transportation provided at the bottom. To be specific, a caster 700 is provided as the attachable and detachable means of transportation at the bottom of the body A 110. To be more specific, the caster 700 includes a pole and a caster part, and the body A 110 includes a groove for insertion of the pole such that the caster 700 is attached to and detached from the body part 100.

In other words, the caster 700 attachable to and detachable from the body A 110 may be used by being connected with the body A 110 when the chamber 10 is moved, and the chamber 10 may be used after removing the caster 700.

In other words, the portable and foldable hyperbaric oxygen chamber according to the present embodiment may be easily kept since the body part may be transformed by including the body A, the body B, and the body C inserted into and overlapped with one another and reduced in volume. In addition, when compared to a case in which only a tube corresponding to a soft chamber is used, the chamber further includes the body part corresponding to a hard chamber and thus may more safely perform hyperbaric oxygen therapy.

In addition, the tube includes an entrance including the external zipper and the internal zipper and thus is effective in preventing the leakage of hyperbaric oxygen in the tube, and preventing hyperbaric oxygen explosion corresponding to the most dangerous factor of the hyperbaric oxygen chamber. To be specific, hyperbaric oxygen explosion corresponding to the most dangerous factor of the hyperbaric oxygen chamber occurs when internal air of the hyperbaric oxygen chamber leaks during expansion and the air touches a spark from an electronic device or the like. The tube according to the present invention has a double structure of the external zipper and the internal zipper and thus may more effectively prevent hyperbaric oxygen leakage from the tube. In addition, the tube further includes protrusions and hooks formed between the external zipper and the internal zipper and thus more effectively prevents oxygen leakage.

In other words, hyperbaric oxygen leakage in the tube is prevented by a multi-structure of the tube, the internal zipper, the protrusions (hooks), the external zipper, the body part, and the body entrance. Thus, hyperbaric oxygen therapy may be more safely performed.

It is clearly understood by those skilled in the art that the present invention may be embodied in other particular forms in accordance with the spirit and essential characteristics of the present invention.

REFERENCE SIGNS LIST

10: Chamber
100: Body part
105: Separation preventing projection
110: Body A
120: Body B
130: Body C
200: Body entrance
210: Guide rails
220: Cover
300: Tube
400: Tube entrance
410: Outer skin
420: Inner skin
411: External zipper
421: Internal zipper
415: First protrusion
425: Second protrusion
415': First hook
425': Second hook
500: Oxygen generator
510: Oxygen injection pipe
520: Oxygen passage entrance
530: Oxygen inlet
600: Oxygen controller
700: Caster

The invention claimed is:

1. A hyperbaric oxygen chamber comprising:
a cylindrical body part configured to be adjustable in size in a longitudinal direction thereof;
a body entrance disposed on a lateral face of the body part;
a cylindrical tube disposed inside the body part;
a tube entrance disposed on a lateral face of the cylindrical tube;
an oxygen injection pipe disposed on a surface of the cylindrical tube; and
an oxygen controller disposed on the surface of the cylindrical tube,
wherein the body entrance and the tube entrance are disposed at positions corresponding to each other,
wherein the cylindrical tube includes a space capable of accommodating a patient, and
wherein the body part includes two or more cylindrical bodies disposed along the longitudinal direction and configured to be inserted into and overlapped with one another.

2. The hyperbaric oxygen chamber according to claim 1,
wherein the two or more cylindrical bodies include a first body and a second body,
wherein each of the first and second bodies has one open end and an opposite closed end, and the first and second bodies face each other, and
the second body is configured to be inserted into the first body from the one open end of the first body.

3. The hyperbaric oxygen chamber according to claim 2,
wherein the two or more cylindrical bodies include at least one third body disposed between the first body and the second body.

4. The hyperbaric oxygen chamber according to claim 1,
wherein the tube entrance is formed such that the tube includes an outer skin and an inner skin, and an external zipper is disposed on the outer skin and an internal zipper is disposed on the inner skin, respectively, and
wherein the external zipper and the internal zipper are separated from each other such that the external zipper and the internal zipper are disposed at positions not overlapping each other.

5. The hyperbaric oxygen chamber according to claim 4, further comprising:

at least one first protrusion disposed on the outer skin;

at least one second protrusion disposed on the inner skin;

wherein the at least one first protrusion and the at least one second protrusion are positioned between the external zipper and the internal zipper, and disposed along longitudinal directions of the zippers, and wherein the at least one first protrusion and the at least one second protrusion are connected with each other.

6. The hyperbaric oxygen chamber according to claim 4, further comprising:

at least one first hook disposed on the outer skin;

at least one second hook disposed on the inner skin;

wherein the at least one first hook and the at least one second hook are positioned between the external zipper and the internal zipper, and disposed along longitudinal directions of the zippers, and wherein the at least one first hook and the second hook are connected with each other.

7. The hyperbaric oxygen chamber according to claim 1, wherein the body part includes an attachable and detachable caster at a bottom.

* * * * *